United States Patent [19]

Ciociola

[11] Patent Number: 4,662,519

[45] Date of Patent: May 5, 1987

[54] DOLLHOUSE JEWELRY BOX

[76] Inventor: Edward M. Ciociola, Box 3800, Hickory, N.C. 28603

[21] Appl. No.: 809,262

[22] Filed: Dec. 16, 1985

[51] Int. Cl.[4] ..... B65D 43/20; B65D 55/02

[52] U.S. Cl. ..... 206/457; 206/1.5; 220/345; 312/204; 312/273; 446/76; 446/108; 446/476

[58] Field of Search ..... 49/68, 69; 109/22, 26, 109/67, 73, 78, 80, 81; 206/1.5, 457; 220/345, 352; 312/204, 273, 301; 446/74–76, 108–116, 124, 127, 476, 478

[56] References Cited

U.S. PATENT DOCUMENTS

| | | | |
|---|---|---|---|
| 1,233,605 | 7/1917 | Ridley | 206/1.5 |
| 1,449,519 | 3/1923 | Layton | 446/110 |
| 1,567,849 | 12/1925 | Kliner | 446/110 |
| 2,204,319 | 6/1940 | Parsons | 446/112 |
| 3,516,389 | 6/1970 | Meyer | 446/476 |

FOREIGN PATENT DOCUMENTS

| | | | |
|---|---|---|---|
| 2155972 | 5/1973 | Fed. Rep. of Germany | 446/114 |
| 2524289 | 10/1983 | France | 312/204 |
| 2044327 | 10/1980 | United Kingdom | 49/68 |

*Primary Examiner*—George E. Lowrance
*Assistant Examiner*—Jimmy G. Foster
*Attorney, Agent, or Firm*—Roy B. Moffitt

[57] ABSTRACT

A dollhouse jewelry box having a base containing a plurality of grooves, four fixed and four moveable walls, two gables and two moveable roof members, two of the fixed walls are aligned, paired and spaced apart from respective paired moveable walls and one of the moveable walls is a key wall. The moveable walls are disposed and slideably received in the grooves in the base, their lateral terminal portions either interface with the lateral terminal portions of one of the fixed walls and/or the lateral terminal portions of other moveable walls in an interlocking manner to form an interlocking combination delimiting an enclosure, the interlocking combination being secured (locked) at a point created by a laterally and inwardly extending protrusion (affixed to the innermost surface of one of the moveable walls, a key wall) the terminal portion which is slideably received in a groove in a fixed wall with which the moveable wall is paired so that by sliding the moveable key wall and the protrusion from a first (locking) to a second (unlocking) position in the groove the moveable key wall can be moved to disengage the innerlocking terminal portions of the moveable and fixed walls. Roof members are slideably attached to the gable members, which in turn are affixed to the fixed walls, and one of the roof members has a locking means adapted to be moved from a locking to an unlocking position on its underside whereby in the locking position the lateral terminal portion of the roof members engaged with one another and in the unlocking position one of the roof members may be moved, thereby disengaging one roof member from the other.

21 Claims, 25 Drawing Figures

FIG. 3
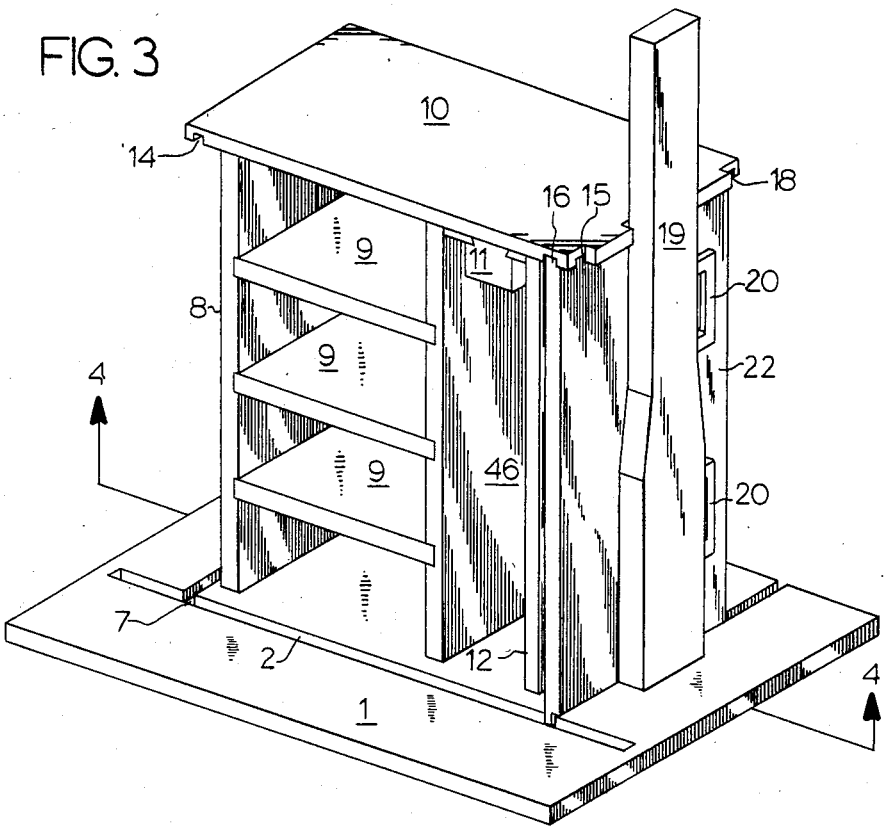
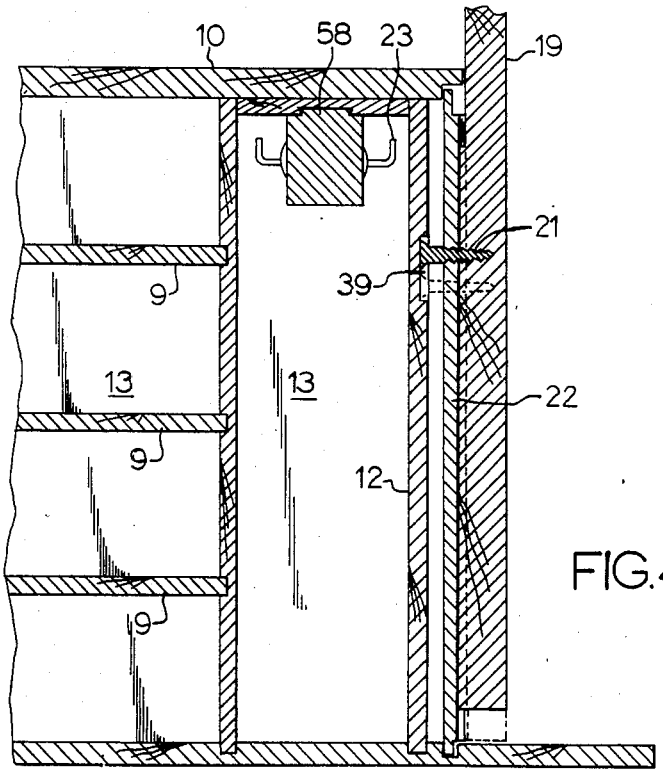
FIG. 4

FIG. 12
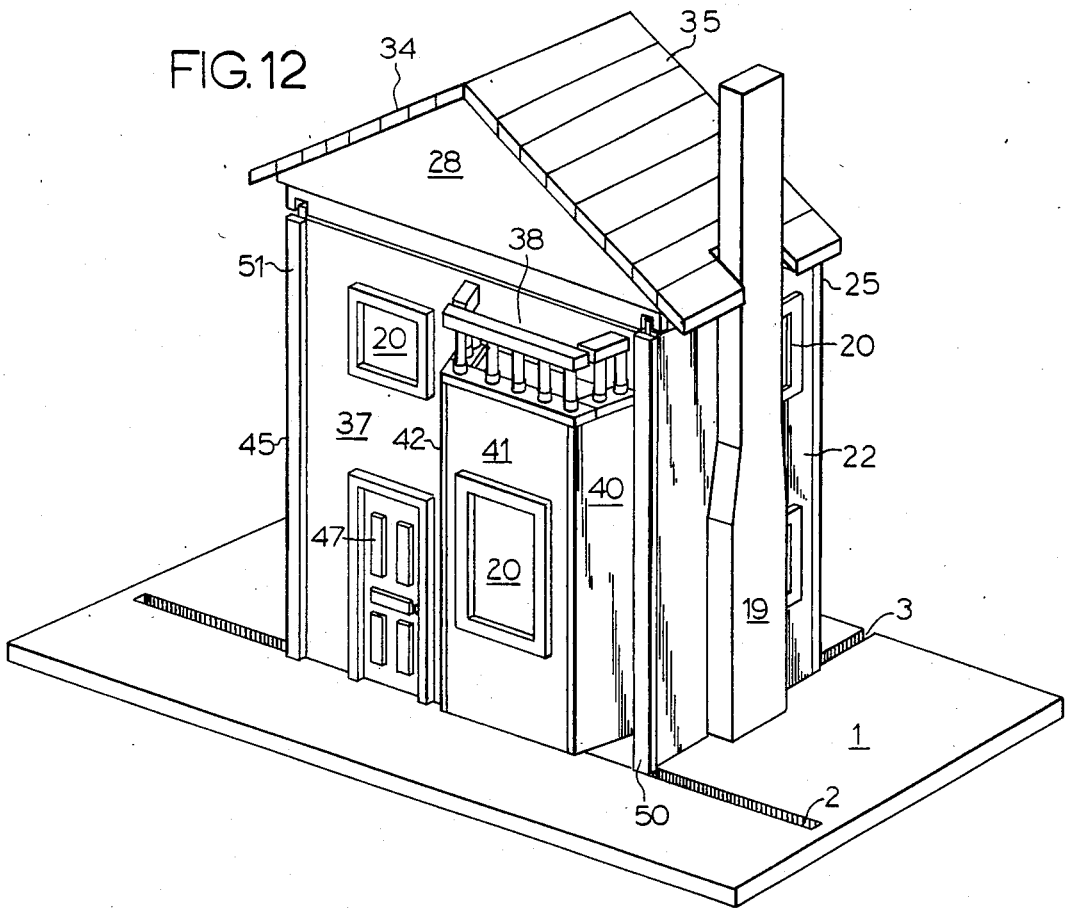
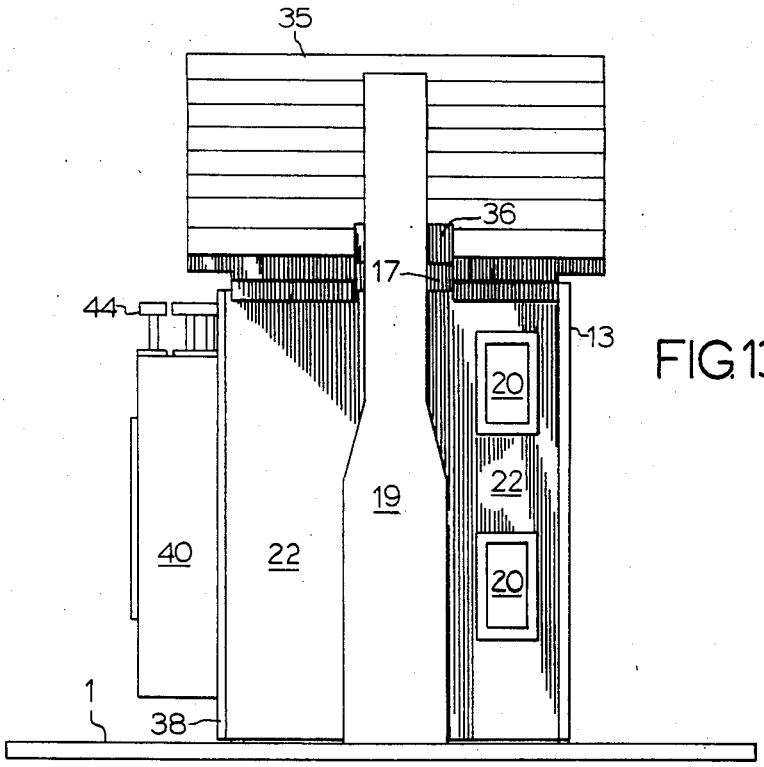
FIG. 13

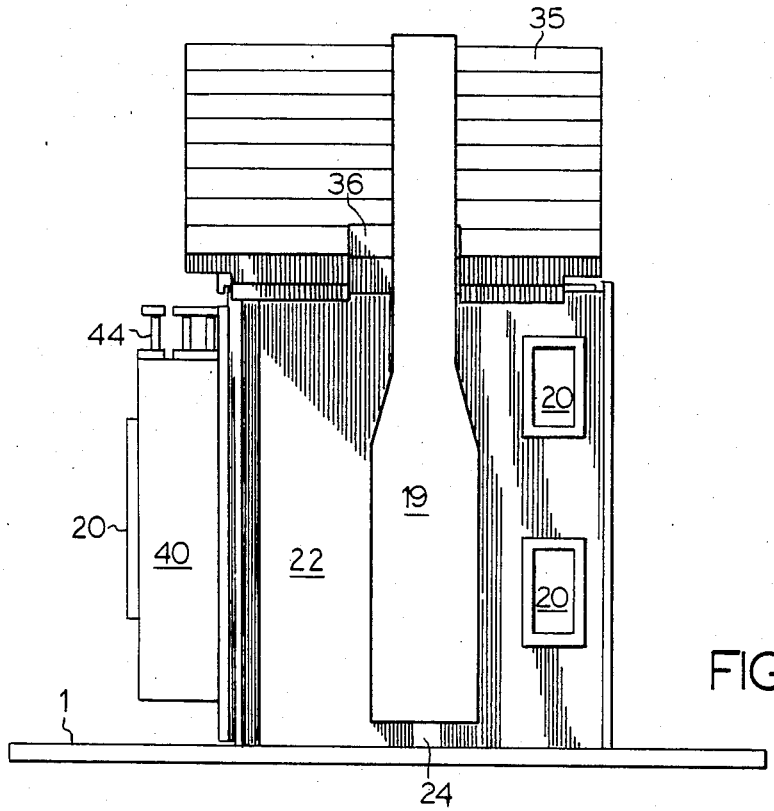
FIG. 14
FIG. 15
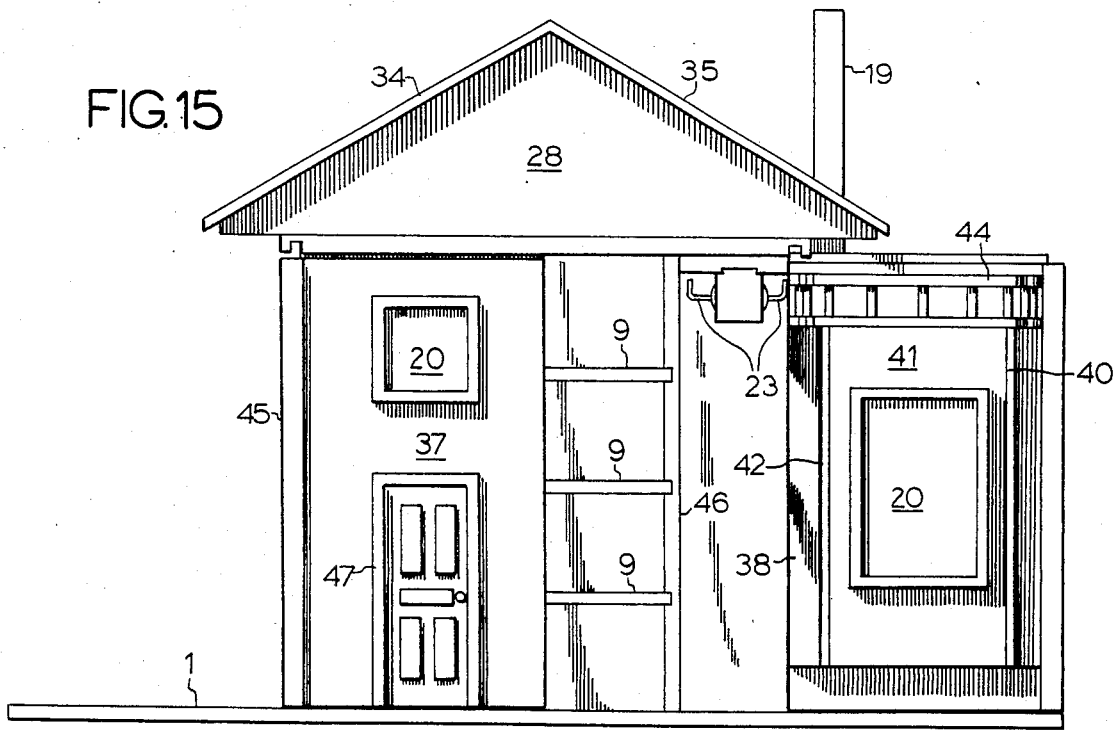

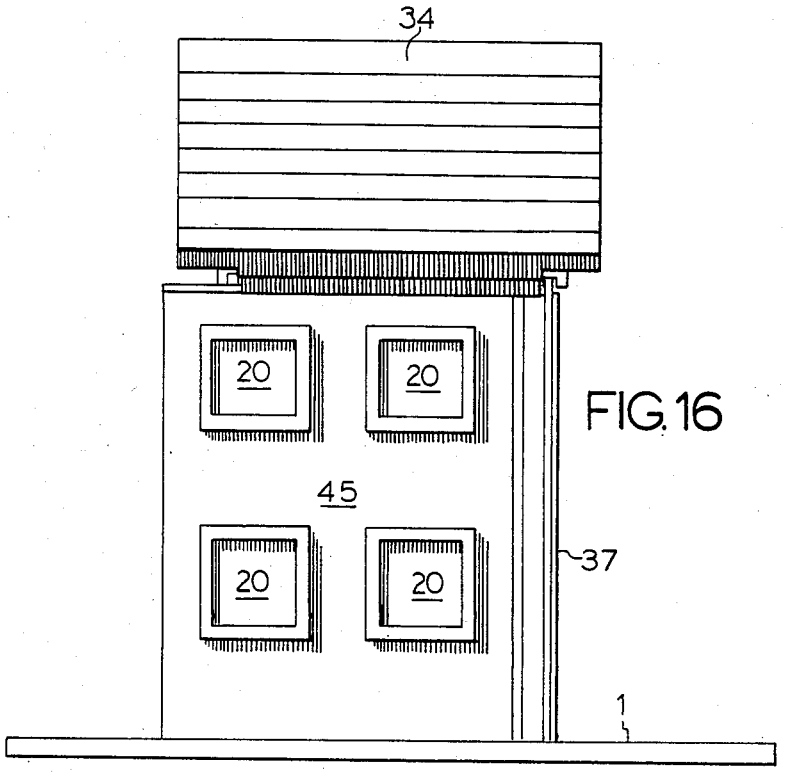
FIG. 16
FIG. 17
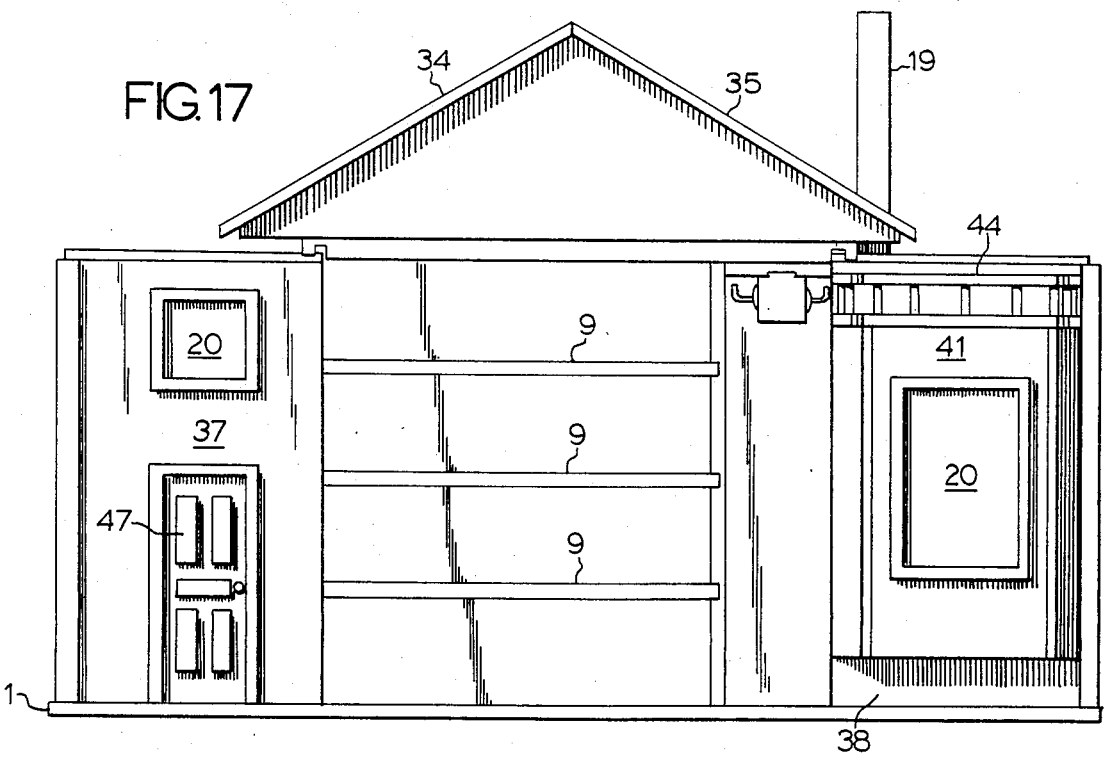

DOLLHOUSE JEWELRY BOX

BACKGROUND OF THE INVENTION

The disclosed invention (a dollhouse jewelry box) is a "disguised" jewelry box, constructed to have all of the outward appearances of being a child's dollhouse, but in reality is a jewelry box suitable for the storage of items of jewelry. One would hope that the disguise affected by the instant jewelry box would be sufficient, in the presence of those disposed towards criminal activity, to cause unwanted persons to overlook a dollhouse as a likely depository for items sought after by those bent on attaining ill gotton gains.

The jewelry box is one that simulates a dollhouse. The dollhouse itself is composed of a base having a plurality of grooves, a plurality of wall members (some affixed to the base and some slideable in grooves in the base) two gables and two roof members. Two of the moveable wall members are paired, aligned with and spaced apart from a like number of fixed wall members affixed to the base. One of the moveable wall members (key wall) has a laterally and inwardlly extruding protrusion, a terminal portion of which is slideably received in a shaped groove in the outermost surface of the fixed wall paired with it and adapted to be moved from a "locked" to an "unlocked" position. Each moveable wall member has a bottom terminal portion slideably received in one of the grooves and lateral terminal portions interlocked with lateral terminal portions of either another moveable wall or a fixed wall so that the moveable walls (at least three in number) in combination with a fixed wall form a combination of walls delimiting an enclosure. The moveable key wall can be placed in a locked position by disposing the inwardly extruding protrusion in a first position. Moving the moveable key wall from a locked (first) to an unlocked (second) position results in the moveable key wall being moved within its groove in the base a distance sufficient to disengage its lateral terminal portion from the lateral terminal portion of another moveable and fixed wall thereby permitting movement of other moveable walls along the grooves in which a bottom terminal portion thereof are slideably received. Such action exposes the cavity, delimited by the moveable walls and one fixed wall, by forming an opening in the cavity sufficient to deposit and retrieve jewelry items. By returning the moveable walls and the moveable key wall back to their respective initial "locked" position, the dollhouse takes on its intended disguise as a dollhouse while functioning as a jewelry box.

BRIEF DESCRIPTION OF THE DRAWINGS

FIG. 3 is a perspective view of the combination of FIG. 2 plus a moveable key wall.

FIG. 4 is a partial cross-sectional front elevation view of the combination shown in FIG. 3 along line 4—4.

FIG. 12 is a perspective view of the front portion of the invention in its "locked" position.

FIG. 13 is a side elevation view of the dollhouse jewelry box of FIG. 12 with its moveable key wall in its locked position.

FIG. 14 is a side elevation view of the dollhouse jewelry box of FIG. 13 with its moveable key wall in an unlocked "up position".

FIG. 15 is a front elevation view of the dollhouse jewelry box in its unlocked mode, exposing a portion of its interior.

FIG. 16 is a side elevation view of the dollhouse jewelry box showing the outside moveable wall opposite from the moveable key wall of FIG. 14 in its unlocked position.

FIG. 17 is a front elevation view of the dollhouse jewelry box exposing its interior cavity.

DETAILED DESCRIPTION OF THE INVENTION

Figure 1:
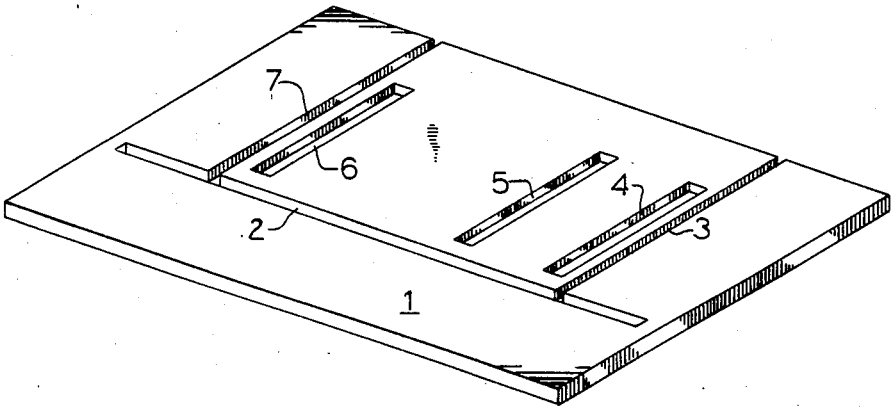
FIG. 1 is a perspective view of the base of the dollhouse jewlery box.
Figure 2:
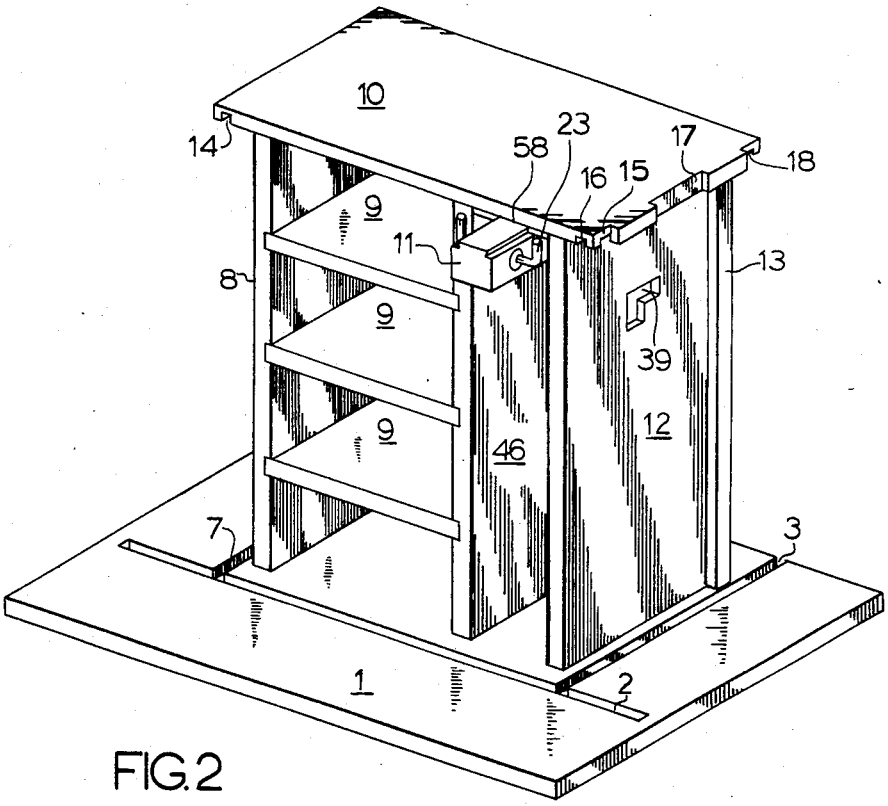
FIG. 2 is a perspective view of the base of FIG. 1, a plurality of upstanding fixed wall members affixed to the base and a cover affixed to one of the upstanding fixed wall members.
Figure 5:
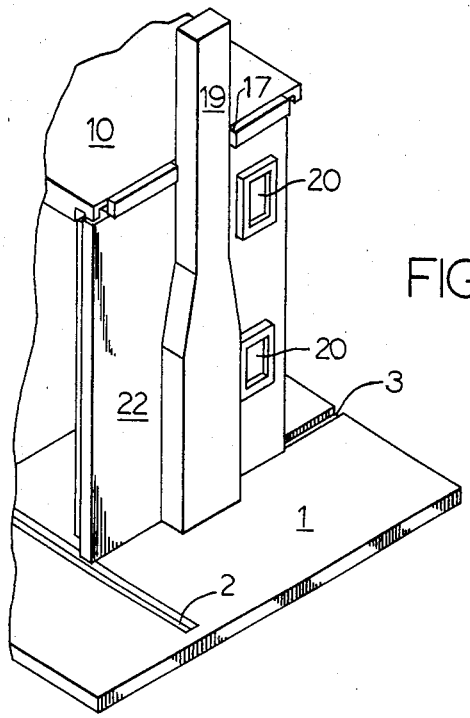
FIG. 5 is a partial perspective view of the moveable key wall of FIG. 5 in a lowered position.
Figure 6:
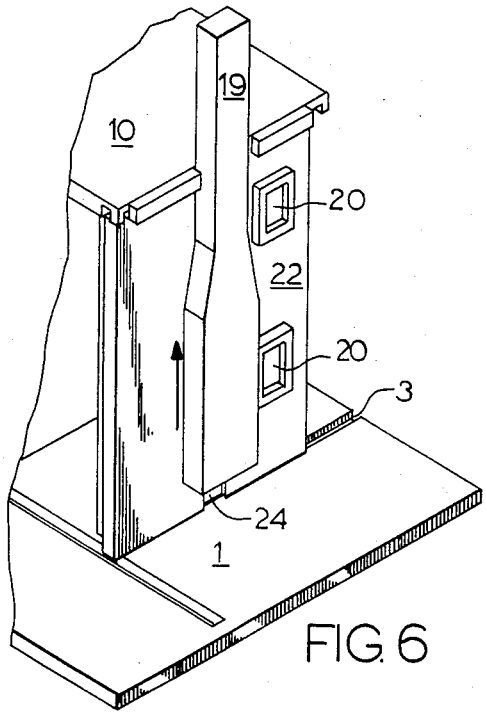
FIGS. 6 and 7 are partial perspective views of the moveable key wall of FIG. 5 in its raised and moved positions respectively.

The dollhouse jewelry box of the present invention is composed, like most houses, of a base, a plurality of upstanding walls and a roof and is shown in its "locked" mode in FIG. 12. The base of the invention is shown as element 1 in FIG. 1. Base 1 has a plurality of grooves therein as indicated by elements 2, 3, 4, 5, 6 and 7, which are adapted to receive therein a terminal end portion of a wall member, as will be more fully explained hereafter. Grove 2 is perpendicular to and communicates with grooves 3 and 7. Elements 4, 5 and 6 in base 1 are grooves that are adapted to receive fixed wall members 12, 46 and 8 respectively. Fixed wall member 8 is fixedly attached to base 1 and is received in grooves 6; fixed wall 46 is fixedly attached and received in groove 5 and fixed wall 12 is fixedly attached and received in groove 4. Also attached to base 1 is fixed backwall 13 which may also be affixed to walls 12, 46 and 8.

In the outermost surface of fixed wall 12 is an overturned "L" shaped groove 39, the function of which will be hereinafter described. Connected to fixed wall 8 and 46 are cross members 9 which act as shelves or support members for drawers if desired. Affixed to at least one of fixed walls 8, 46 and 12 is cover 10. In one end portion of cover 10 is a slot denoted by element 17 adapted to receive chimney 19. On its undersurface there are grooves 14, 15, and 16, all of which are adapted to slideably receive upstanding moveable wall members as will be hereinafter described. Between wall members 46 and 12 is rack 11 slideably received in groove 58 in the lowermost surface of cover 10.

Slideably disposed in groove 3 is upstanding movable key wall member 22. On the outermost surface of moveable key wall 22 may be a plurality of decorative simulated window members 20. The lowermost and uppermost terminal portion of moveable key wall member 22 is shaped so that these terminal portions can be slideably fitted into grooves 3 and 16 respectively, thus permitting the movement of moveable key wall 22 along grooves 3 and 16. Moveable key wall 22 has affixed thereto element 19, which is shaped like an upstanding chimney. On the innermost surface of chimney 19 and moveable key wall 22 is affixed a laterally extending protusion 21 (FIG. 4) having a length so that at least a portion of it is slideably received in groove 39 of fixed wall member 12. Coaction between protrusion 21, groove 39, grooves 3 and 16 and moveable key wall 22 provide a lock for the dollhouse jewelry box, which will be more clearly described in subsequent disclosure. Rack 11 contains a plurality of laterally extending hangers 23 adapted to receive necklaces and other items of jewelry. Chimney 19 has a tongue 49 on its innermost surface and moveable wall 22 has a groove 24 therein in which this tongue 49 slideably fits.

Figure 7:
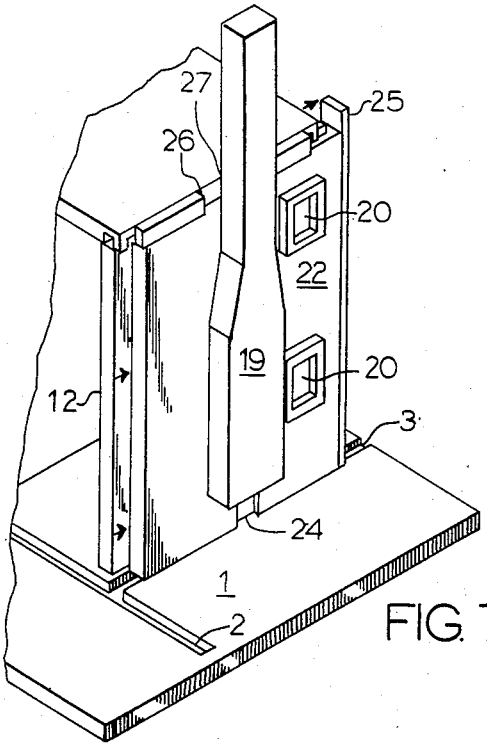
Figure 8:
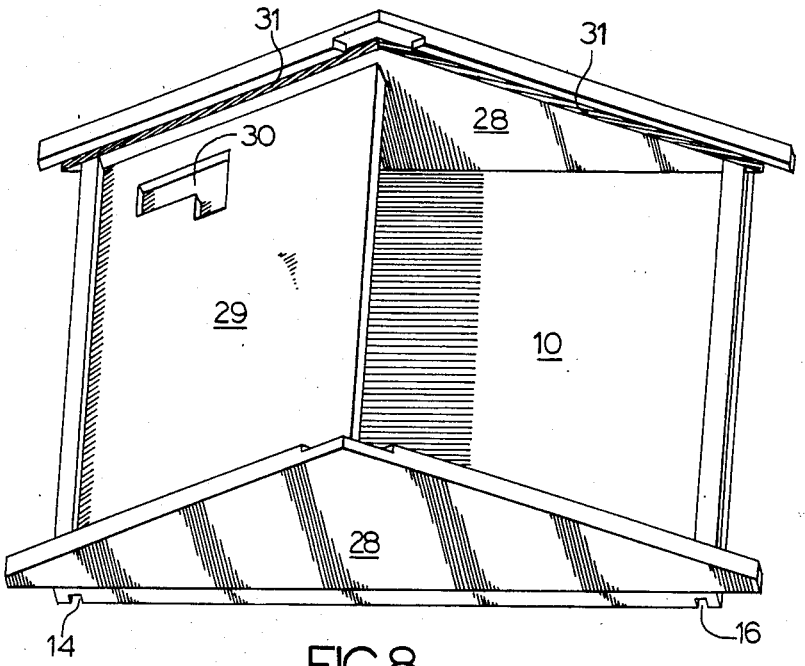
FIGS. 8, 9, 10 and 11 are partial perspective views of the roof of the invention.

Attention is invited to that position of chimney 19 shown in FIGS. 4, 6, 7 and 14. In each of these figures the position of chimney 19 is the same, i.e., it is in an uplifted position. In contrast, attention is directed to the position of chimney 19 in FIGS. 3, 5, 12, and 13, where it is in its downward-most position. Once chimney 19 is raised (FIGS. 4 and 6) by sliding chimney 19 upward along groove 24 and protrusion 21 along the vertical portion of groove 39, moveable key wall 22 is positioned to be moved to laterally a predetermined distance, i.e., the distance between two points indicated by elements 26 and 27 of FIG. 7. Movement of moveable key wall 22 from that point indicated by element 26 to that point indicated by element 27 is obviously delimited by the lateral dimension of groove 39. The width of chimney 19 is so designed so that its front leading edge can move the distance between points indicated by elements 26 and 27. By moving moveable key wall 22 to the right, as shown by FIG. 7 and thus disengaging it from moveable wall 38, as will be discussed more in detail at a later time, moveable wall 38, slideably disposed in groove 2, may be slideably moved along groove 2 thereby exposing the interior of the jewlery box for its utlimate utilitarian purpose.

Strip 25 is attached to the lateral upstanding terminal portion of moveable wall 22 in the manner shown in FIG. 7 and provides disguise for the intersection of moveable wall 22 and fixed wall 13. As will be more fully explained later, the other lateral terminal portion (the left-hand terminal portion) of moveable wall 22 protrudes beyond the lateral free edge of moveable wall 38 disposed in groove 2 when the dollhouse is in its closed position thereby locking that moveable wall into a non-moveable position until moveable wall 22 is moved as explained above.

Figure 9:
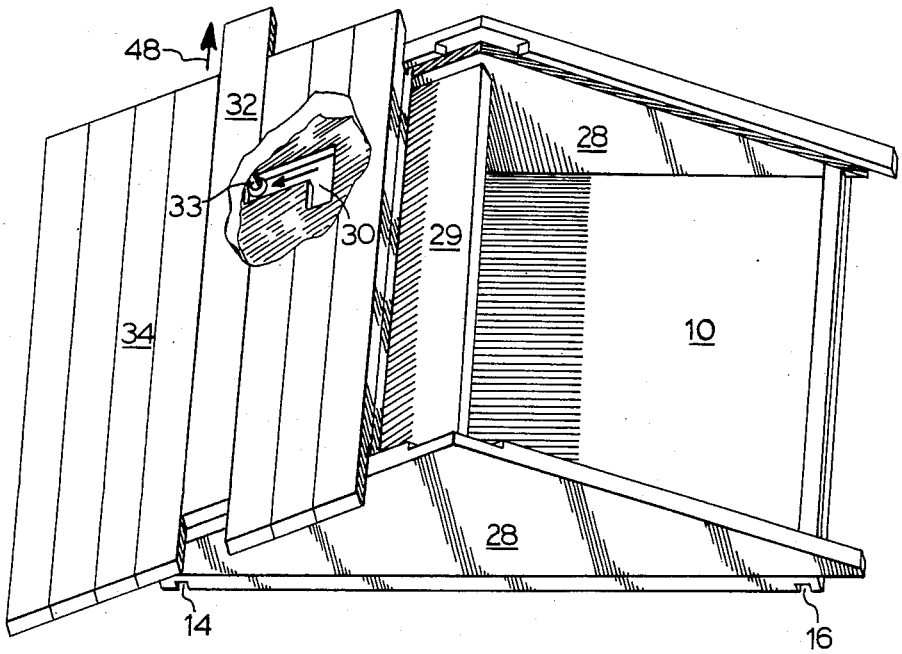
Figure 10:
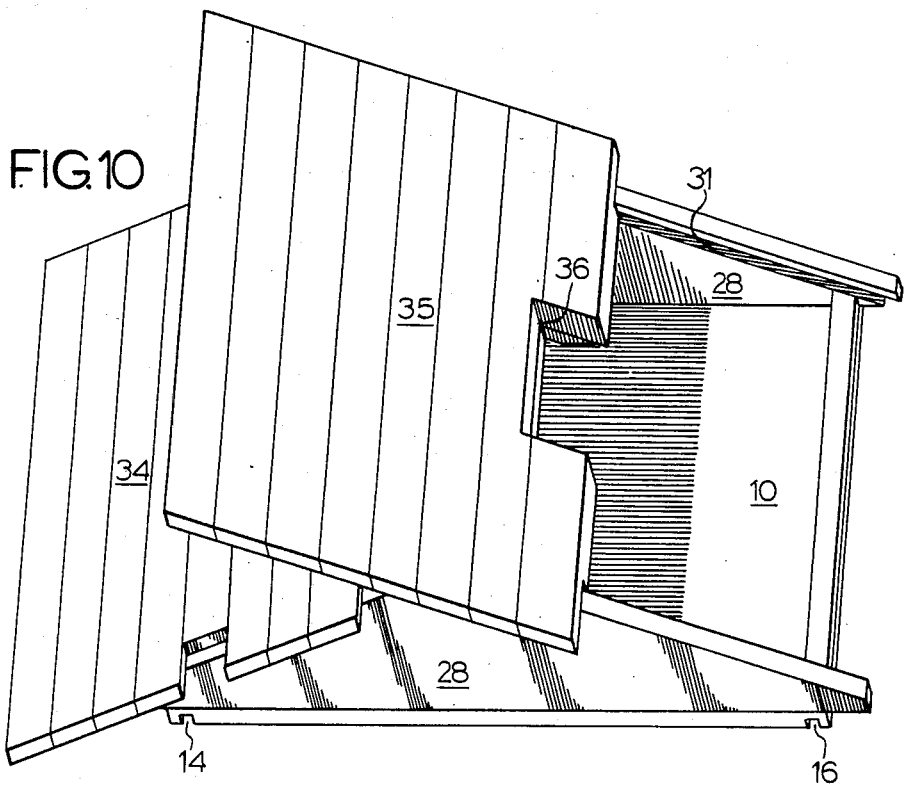
Figure 11:
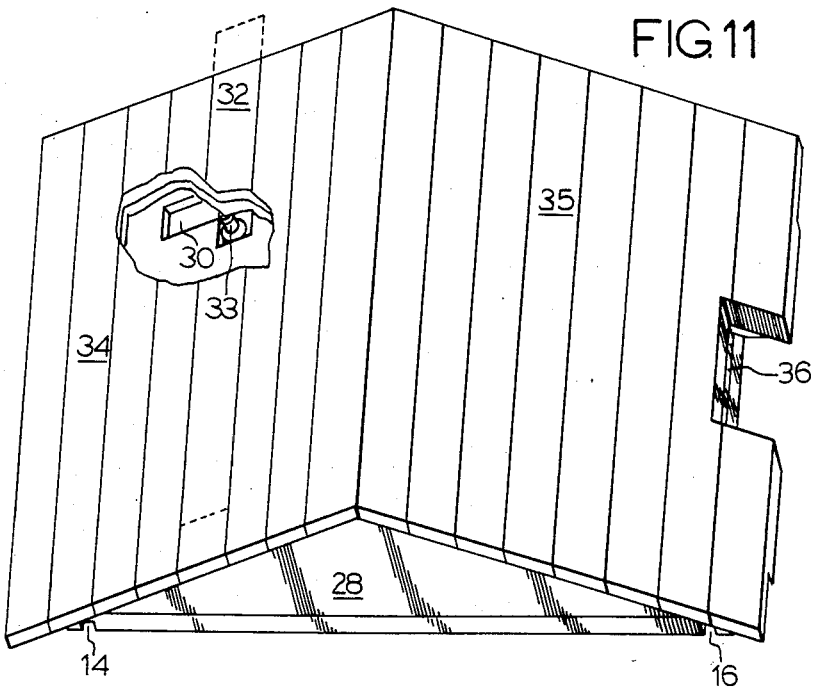

Shown in FIGS. 8, 9, 10 and 11 is the roof portion of the invention. This portion comprises two gable means 28, both of which have grooves on their innermost surfaces in their uppermost terminal portions as indicated by element 31. Both roof members 34 and 35 are slideably received in such grooves. Disposed below such grooves and roof portion 34 is sub-roof 29 affixed to both gables 28. In the uppermost surface of sub-roof 29 is an "L" shaped groove 30. Roof portion 34 has a moveable portion (slat 32) moveable from one position to the other as indicated in FIG. 9. Affixed to the under surface of slat 32 is downward extending protrusion 33, a portion of which is received and slideable in slot 30. Roof member 35 has a slot in one terminal portion indicated by element 36 into which one terminal portion of chimney 19 is received. As shown in FIGS. 9, 10 and 11, roof members 34 and 35 are slideably received in grooves 31. Slot 36 is aligned with chimney 19. A terminal portion of roof member 34 abuts with a like portion of roof member 35 and thus prohibits movement of either one in such a position. The left-hand terminal portion of roof member 35 intersects the right-hand terminal portion of roof member 34 thereby locking roof members 34 and 35 together until one is moved relative to the other. See FIG. 11.

Slat 32 and protrusion 33 are used to "unlock" and "lock" the roof. By first moving slat 32 in the direction indicated by directional arrow 48 (FIG. 9) the distance also delimited by slot 30 then moving roof member 34 downward a distance also delimited by slot 30, roof member 34 can be removed from its otherwise locked position relative to the other roof member 35. Once this happens, roof member 35 is free to move in the left-hand and upward direction and may be removed thereby, exposing an interior cavity composed of elements 28, 10, and roof member 34. Roof members 34 and 35 are made up of a plurality of slats (unnumbered) affixed to one another. Only slat 32, a part of roof 34, is moveable and not affixed to the other slats in the same manner as previously described. The lock, composed of slat 32 protrusion 33 and groove 30, operates much in the same manner as that combination previously described relating to moveable key wall 22, chimney 19, groove 39 and protrusion 21.

Figure 18:
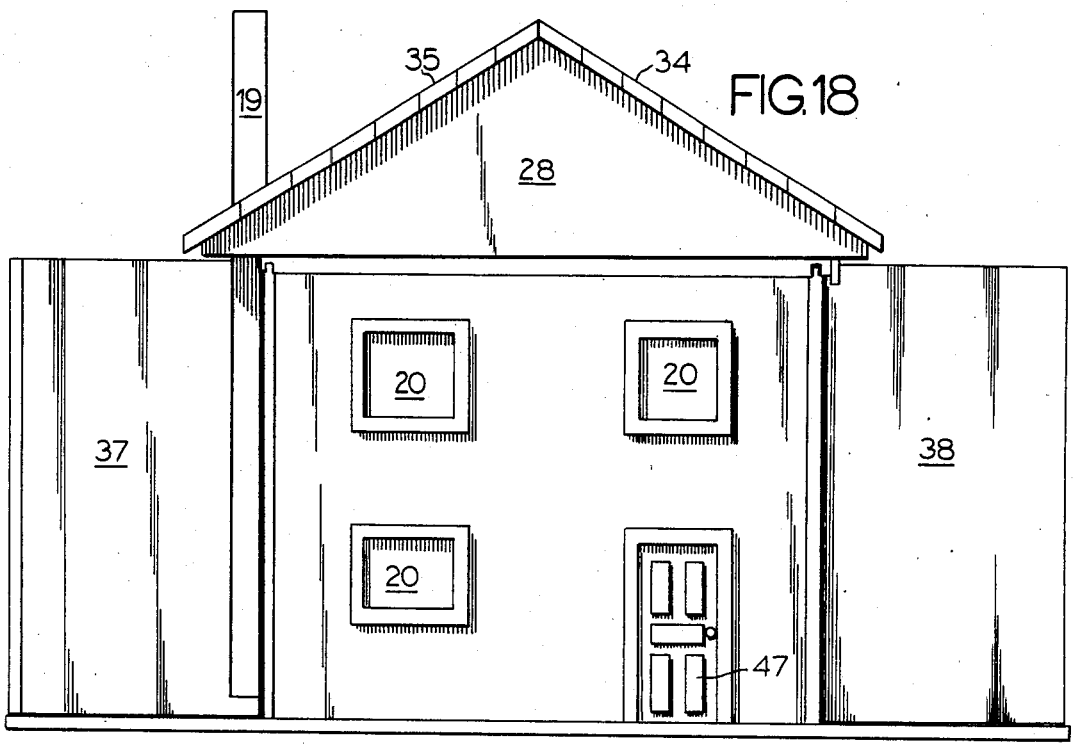
FIG. 18 is a front elevation of the reverse side of the dollhouse jewelry box of FIG. 17.

FIG. 12 shows a perspective view of the front portion of the dollhouse jewelry box in its "locked" position. FIGS. 13, 14, 15, 16 and 17 illustrate the steps that need to be taken to transform the dollhouse jewelry box from its locked to its unlocked position as shown in FIG. 17. In FIG. 18, the dollhouse jewelry box is shown in its unlocked position but from the rear; i.e., the point of observation opposite from that shown in FIG. 17.

Figure 19:
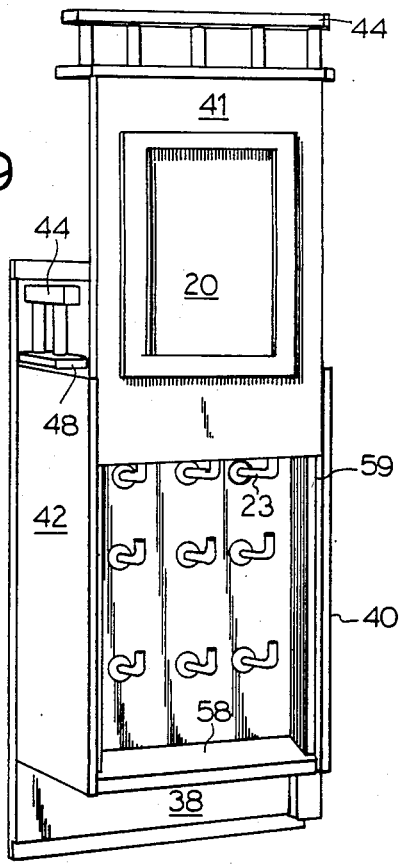
FIG. 19 is a perspective view of the construction of a decorative compartment attached to moveable wall 38.

A decorative protrusion is affixed to moveable wall 38 (FIG. 19) and is composed of a balustrade 44, sidewalls 40 and 42 and upper and lower walls 48 and 58, such walls forming in combination with wall 38 an enclosure. Sidewall 40 and 42 have grooves 59 in their terminal portions in which moveable wall 41 is slideably received and which rest on bottom wall 58. Moveable wall 41 has a portion of balustrade 44 attached to it so it will mesh with side portions of balustrade 44. Hooks 23 are affixed to backwall 38 and are adapted to receive and retain items of jewelry such as rings for storage.

Figure 20:
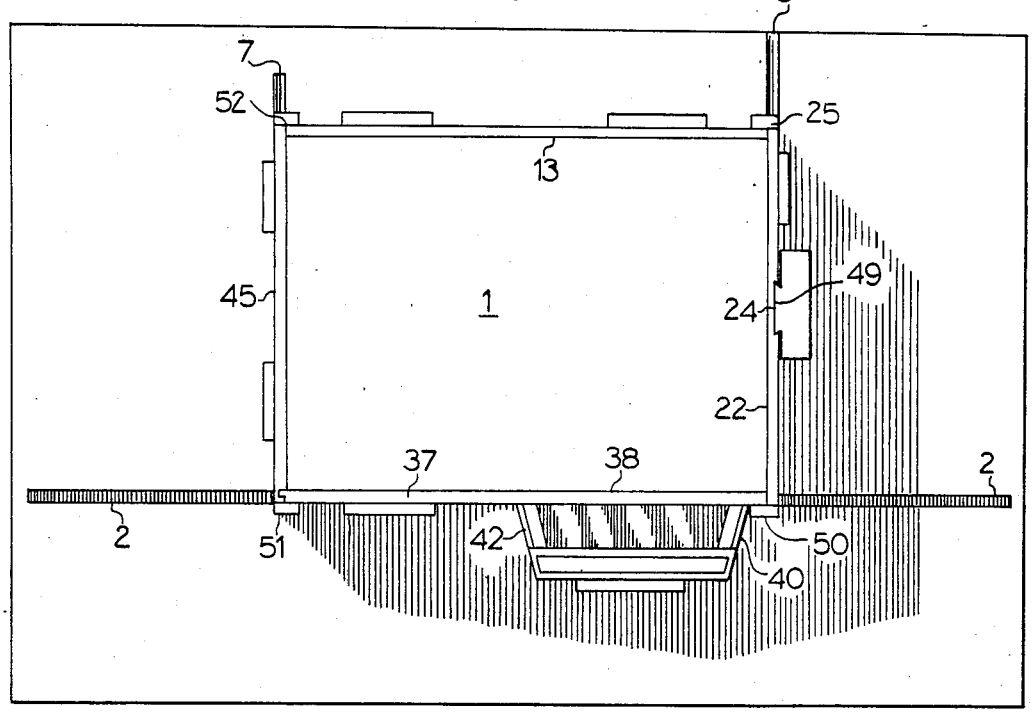
FIGS. 20, 21, 22, 23, 24 and 25 are plan views of the base, back fixed wall and moveable walls describing the interlocking arrangement of the walls in combination with one another (FIG. 20) and the sequential wall movements (FIGS. 21–25) necessary to unlock the wall combination to expose the interior of the dollhouse jewelry box.
Figure 21:
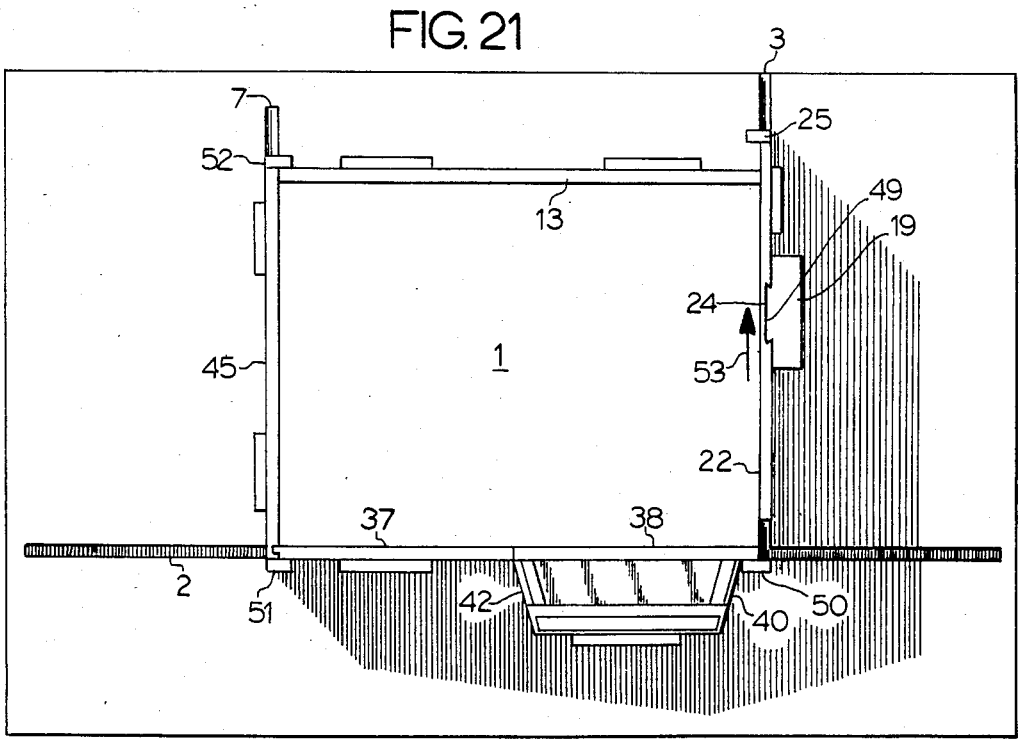
Figure 25:
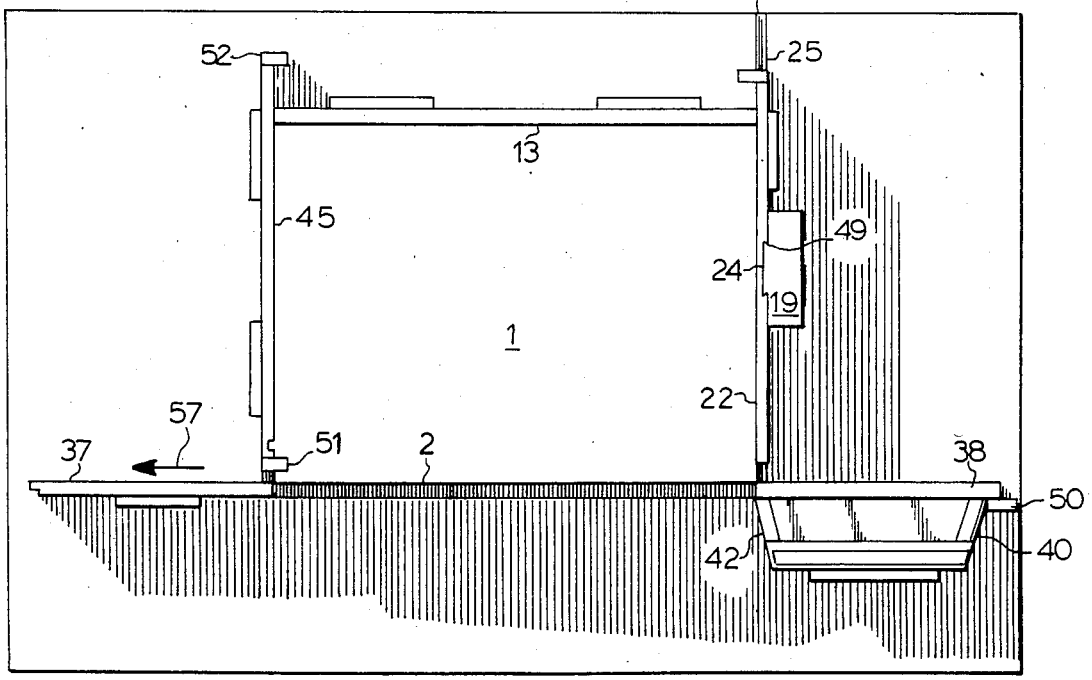

In order to understand the movements required to unlock the dollhouse jewelry box, i.e., to convert the jewelry box from that configuration shown in FIG. 12 to that of FIGS. 17 or 18, an understanding of the structure and the movement of certain walls as described in FIGS. 20 through 25 is essential. FIGS. 20 through 25 show the sequential movements of the walls of the dollhouse jewelry box from its locked configuration (FIG. 20) to its unlocked position (FIG. 25). The locked jewelry box, as shown in FIG. 20, is shown in schematic form, showing the outside moveable and fixed walls only; namely, walls 22, 13, 45, 37 and 38.

Figure 22:
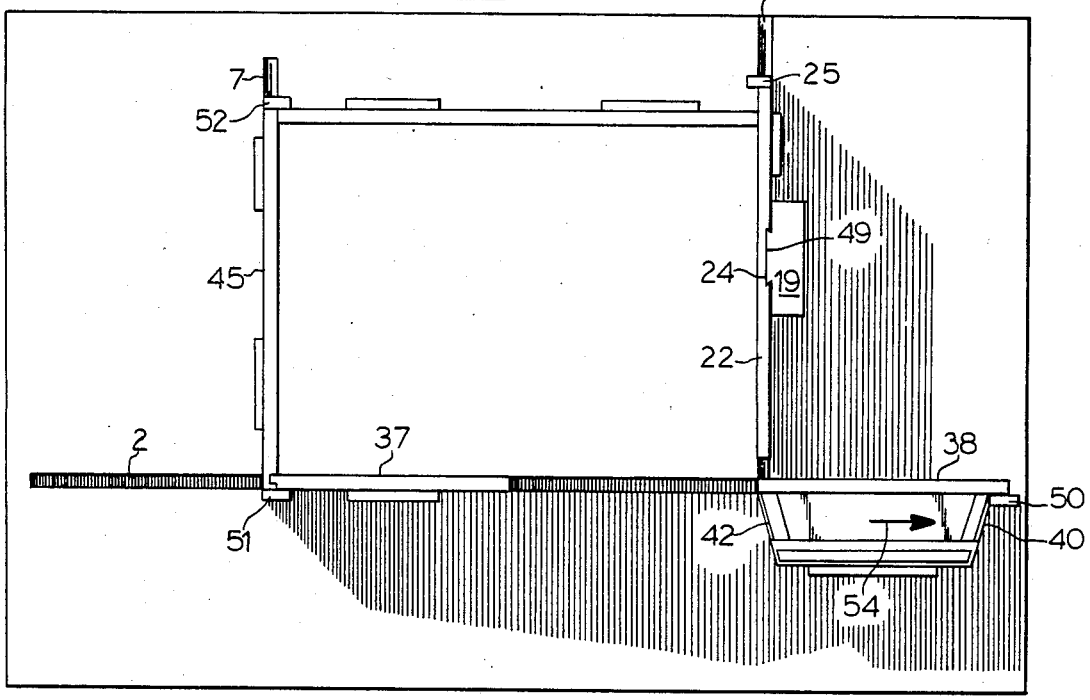
Figure 23:
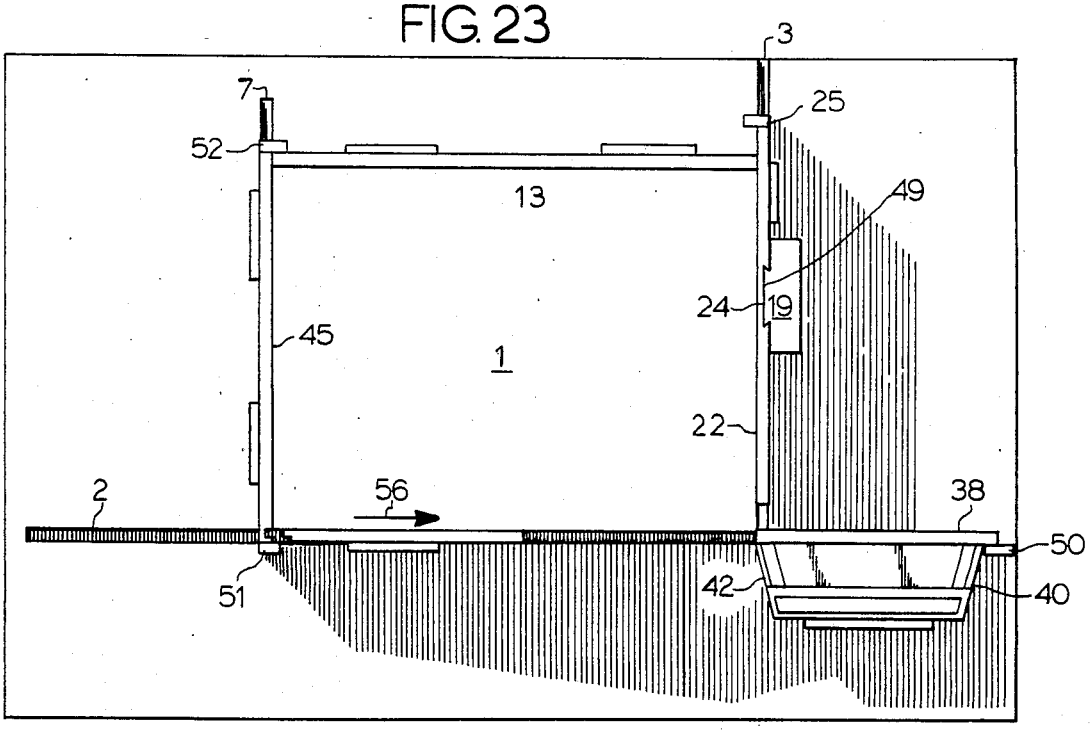
Figure 24:
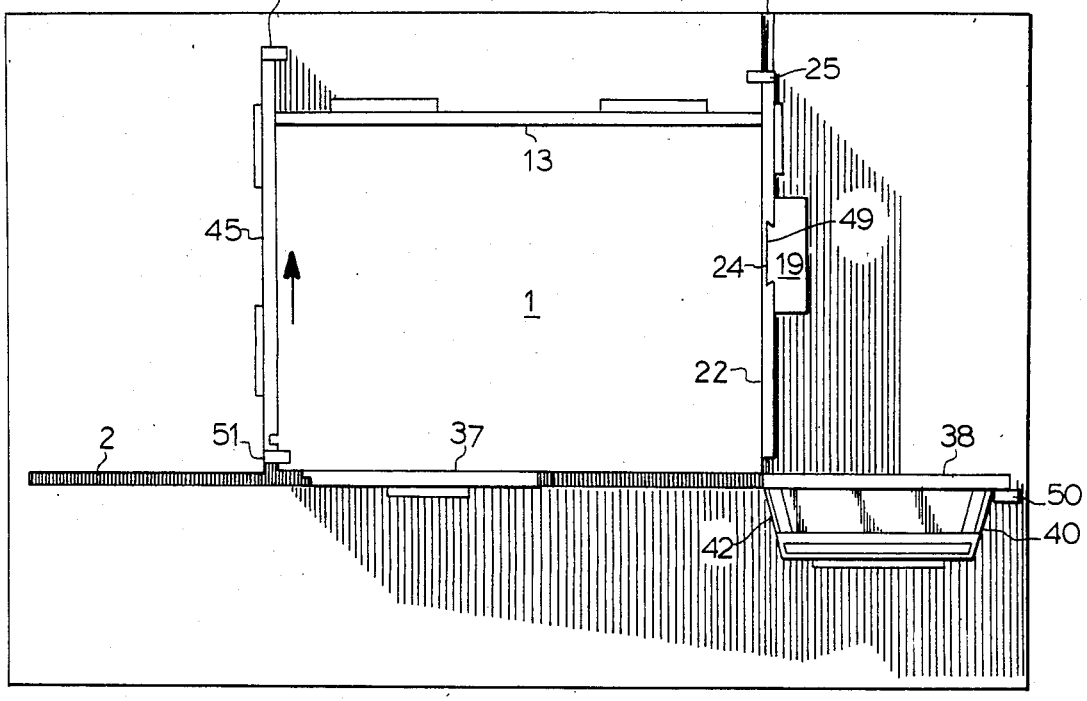

To moveable wall 22 there is affixed tab 25 to one lateral terminal portion, the disguise function of which is apparent (cover the joint between abutting walls). Fixed wall 13 abuts against moveable wall 22 and the joint between fixed wall 13 and moveable wall 22 is covered by tab 25, affixed to moveable wall 22. A like configuration exists on the opposite lateral terminal portion of moveable wall 22, namely, tab 50 is affixed to wall 38 covering the joint between moveable walls 38 and 22. Moveable walls 37 and 38 are slideably received in slot 2 and moveable wall 22 is slideably received in slot 3. Moveable wall 45 presents a similar configuration. Tab 52 is affixed to the one terminal edge portion of moveable wall 45 and covers the joint between fixed wall 13 and moveable wall 45. Tab 51 is affixed to a terminal portion of moveable wall 45 and covers the joint between moveable wall 37 and moveable wall 45. Moveable wall 45 is slideably received in slot 7. Moveable wall 37 abuts against moveable wall 38 in between tabs 50 and 51 and the joint therebetween may be covered by a tab (not shown) like that of Element 50. The above described combinaton comprises a "lock" for the dollhouse jewelry box. To unlock it, one must carry out the following:

The first step in unlocking the dollhouse jewelry box is to raise chimney 19 in an upward fashion, as previously described, and then move it in the direction of directional arrow 53. Note tongue 49 of chimney 19 and groove 24 in moveable wall 22. Chimney 19 is moved upward and this upward movement is directed by the tongue 49 and groove 24 combination and delimited by groove 39 and protrusion 21. Then chimney 19 (and moveable key wall 22) is moved (see FIG. 14) in the direction of directional arrow 53, causing moveable key wall 22 to move out of that portion of groove 2 where it blocks movement of moveable wall 38. See FIG. 21 for example. In this position (FIG. 21) moveable wall 38 is free to slide to the right along groove 2. In FIG. 22 moveable wall 38 is shown moved to the right or in the direction as shown by directional arrow 54. The next step is to free up moveable wall 37 so that moveable wall 45 can be moved in the direction shown by directional arrow 55. See FIG. 24. This is done by moving moveable wall 37 in the direction shown by directional arrow 56. See FIG. 23. Thereafter, moveable wall 45 is moved in a direction shown by directional arrow 55. See, for example, the arrangement of the aforementioned walls in FIG. 24. Once wall 45 has been moved to that position shown in FIG. 24, moveable wall 37 can be moved to the left, i.e., in the direction indicated by directional arrow 57 thereby exposing the entire interior cavity of the dollhouse jewelry box, apart from that cavity created by the roof members, gables and subroof. By reversing the aforedescribed procedure, the interior cavity of the dollhouse jewelry box can be enclosed and locked.

As set forth above, there has been disclosed a dollhouse jewelry box comprising a base containing first, second and third grooves, the first groove 2 being essentially perpendicular to and in communication with second and third grooves 3 and 7. On the base there are first, second, third and fourth upstanding fixed sidewalls (elements 12, 46, 8 and 13), joined together in such a fashion to form a partial enclosure, which is partially circumscribed by grooves 2, 3 and 7. Additionally, there are first, second and third upstanding moveable sidewalls, each having innermost and outermost surfaces, lateral, top and bottom terminal portions. Each of these moveable sidewalls have a bottom terminal portion slideably received in the respective first, second and third grooves, their lateral terminal portions in removeable abutting engagement with each other and/or a lateral terminal portion of either the first, third or fourth fixed wall. There is a fourth groove (Element 39) located in the outermost surface of the first upstanding fixed side-wall and a laterally extending protrusion (Element 21) affixed to the innermost surface of the second upstanding moveable sidewall, a portion of which is slideably received in the fourth groove of the first upstanding fixed sidewall adapted to be moved within the groove from a first to a second position so that when the protrusion is in the first position, the lateral terminal portion of the second moveable upstanding sidewall is received in an abutting and locking engagement with a moveable and a fixed wall and when the protrusion is in a second position, the lateral terminal portions of the second upstanding moveable sidewall is not in engagement with the lateral terminal portions of previously abutting moveable and fixed upstanding sidewalls.

What is claimed is:

1. A dollhouse jewelry box comprising:

(a) a base containing first, second and third grooves therein;

(b) first, second and third fixed upstanding sidewalls each having top, bottom and lateral terminal portions, one of the lateral terminal portions of the first and second fixed upstanding sidewalls joined to the lateral terminal portions of the third fixed upstanding sidewall, the bottom terminal portions of the first, second and third fixed upstanding sidewalls being affixed to the base and partially circumscribed by the first, second and third grooves, said first upstanding sidewall having an outermost surface;

(c) means including first, second, and third moveable sidewalls, each having innermost and outermost surfaces, lateral, top and bottom terminal portions, the first moveable sidewall has its bottom terminal portion slideably received in the first groove, the second moveable sidewall has its bottom terminal portion slideably received in said second groove and the third moveable sidewall has its bottom terminal portion slideably received in the third groove, whereby the lateral terminal portions of the first moveable sidewall are in abutting relationship with the second and third moveable sidewall, the lateral terminal portions of the third moveable sidewall are in abutting relationship with the third fixed sidewall and the first moveable wall;

(d) a fourth grooved located in the outermost surface of the first upstanding sidewall; and, (e) means including a protrusion affixed to the innermost surface of the second moveable sidewall protruding laterally, a portion of which is slideably received in the fourth groove and adapted to be moved within said fourth groove from a first to a second position so that when the protrusion is in the first position, the second moveable sidewall is received in abutting relationship with the first moveable sidewall and the third fixed sidewall and when the protrusion is in the second position, the lateral terminal portions of the second moveable sidewall are not in engagement with the lateral terminal portions of the first movable and third fixed sidewalls.

2. The jewelry box of claim 1 wherein the first moveable sidewall is composed of a first and second sections, each having top, bottom and lateral terminal portions, the bottom terminal portions of both first and second sections are slideably received in the first groove; one lateral terminal portion of the first section is in removeable abutting engagement with a lateral terminal portion of the second moveable sidewall, the other lateral terminal portion of the first section is in removeable abutting engagement with a lateral terminal portion of the second section, and one lateral terminal portion of the second section is in removeable abutting engagement with one of the lateral terminal portions of the third moveable sidewall.

3. The jewelry box of claim 1 containing a cover, having upper and lowermost surfaces, attached to the uppermost terminal portions of one of the fixed sidewalls.

4. The jewelry box of claim 3 including two upstanding gables affixed to the cover disposed in spaced apart relationship from and parallel to one another.

5. The jewelry box of claim 4 wherein each gable has an innermost surface and a groove in each of their innermost surfaces.

6. The jewelry box of claim 5 containing first and second roofs both of which have first and second surfaces, top, bottom and lateral terminal portions, the lateral terminal portions of each containing a laterally extending protrusion, the protrusions of the first and second roofs slideably received in the groove in the innermost surface of each of the gables.

7. The jewelry box of claim 6 containing a sub-roof affixed to a portion of each gable disposed substantially co-extensive with and beneath the second roof having an "L" shaped groove therein, the second roof containing a moveable portion including a protrusion extending downwardly therefrom slideably disposed in the "L" shaped groove so that upon moving the moveable portion of the second roof and its protrusion along one portion and then the balance of the "L" shaped groove, the second roof is rendered moveable along the grooves in the gables.

8. The jewelry box of claim 7 wherein the top terminal portion of the second roof abuts against the top terminal portion of the first roof when the protrusion of the second roof is in a predetermined portion of the "L" shaped groove.

9. The jewelry box of claim 3 wherein the lowermost surface of the cover contains a grove and elongated rack slideably received in said groove said rack adapted to be slideably reciprocated from a first to a second position in the groove.

10. The jewelry box of claim 9 including a fourth fixed sidewall affixed to the base and joined to the second fixed sidewall by at least one horizontally disposed member.

11. The jewelry box of claim 10 wherein the first and second sections of the first moveable sidewall have innermost and outermost surfaces and on the outermost surface of either the first or second section there is disposed an enclosed compartment.

12. The jewelry box of claim 11 wherein the enclosed compartment is composed of a plurality of portions joined together to form the compartment and one of the portions is slideably engaged with two of the other portions so that the interior of the compartment may be exposed upon sliding the slideable portion relative to the two other portions.

13. A dollhouse jewelry box comprising:

(a) a base containing first, second and third grooves therein, the first groove being essentially perpendicular to and communicating with the second and third grooves;

(b) first fixed wall member having a groove therein, said first fixed wall member being affixed to the base and disposed essentially parallel to and spaced apart from the second groove; and, (c) means including first, second, and third moveable wall members, a portion of the first moveable wall member being slideably received in the first groove, a portion of the second moveable wall member being slideably received in the second groove and a portion of the third moveable wall member being slideably received in the third groove, the second moveable wall member having a laterally-extending protrusion thereon, a portion of the laterally-extending protrusion being slideably received in the groove in the first fixed wall member.

14. A dollhouse jewelry box of claim 13 including a second fixed wall affixed to the base and spaced-apart from the third groove.

15. A dollhouse jewelry box of claim 14, including a third fixed wall affixed to the base essentially parallel to and spaced apart from the first groove adapted to abut against both the second and third moveable walls.

16. A dollhouse jewelry box of claim 15 wherein the first moveable wall is composed of first and second parts and the first part is adapted to abut against both the third moveable wall and the second part of the first moveable wall.

17. A dollhouse jewelry box of claim 16 wherein the second part of the first moveable wall is adapted to abut against both the second moveable wall and the first part of the first moveable wall.

18. A dollhouse jewerly box of claim 17 including a cover attached to at least one of the first, second and third fixed walls.

19. A dollhouse jewelry box of claim 18 including a roof affixed to the cover, the roof comprising (i) spaced apart gables affixed to the cover each cable having a groove therein, and (ii) first and second roof members each slideably received in the grooves in the gables.

20. A dollhouse jewelry box of claim 19 including a sub-roof affixed to the gables spaced apart from the first roof member and containing a groove therein.

21. A dollhouse jewelry box of claim 20 wherein the first roof member includes a moveable part, and said moveable part having a protrusion thereon, a part of the protrusion being slideably received in the groove in the sub-roof.

* * * * *